US011708734B2

(12) United States Patent
McGarian

(10) Patent No.: US 11,708,734 B2
(45) Date of Patent: Jul. 25, 2023

(54) SWIVEL ANCHOR

(71) Applicant: Bruce McGarian, Aberdeen (GB)

(72) Inventor: Bruce McGarian, Aberdeen (GB)

( * ) Notice: Subject to any disclaimer, the term of this patent is extended or adjusted under 35 U.S.C. 154(b) by 0 days.

(21) Appl. No.: 17/268,074

(22) PCT Filed: Aug. 8, 2019

(86) PCT No.: PCT/GB2019/052231
§ 371 (c)(1),
(2) Date: Feb. 11, 2021

(87) PCT Pub. No.: WO2020/139167
PCT Pub. Date: Feb. 27, 2020

(65) Prior Publication Data

US 2021/0324693 A1 Oct. 21, 2021

(30) Foreign Application Priority Data

Aug. 20, 2018 (GB) ..... 1813539

(51) Int. Cl.
*E21B 17/07* (2006.01)
*E21B 23/01* (2006.01)
*E21B 29/00* (2006.01)

(52) U.S. Cl.
CPC ..... *E21B 23/01* (2013.01); *E21B 17/07* (2013.01); *E21B 29/005* (2013.01)

(58) Field of Classification Search
CPC ..... E21B 17/07; E21B 23/01
See application file for complete search history.

(56) References Cited

U.S. PATENT DOCUMENTS 2,568,256 A 9/1951 Shaffer
2,875,983 A 3/1959 Sufliff
3,463,252 A * 8/1969 Garrett ..... E21B 17/07 175/321

(Continued)

FOREIGN PATENT DOCUMENTS

EP 1001132 A2 * 5/2000 ..... E21B 17/06
WO WO2011/031164 A1 3/2011

OTHER PUBLICATIONS

International Search Report and Written Opinion for PCT/GB2019/052231, dated Oct. 22, 2019.

(Continued)

*Primary Examiner* — Christopher J Sebesta
*Assistant Examiner* — Lamia Quaim
(74) *Attorney, Agent, or Firm* — Klarquist Sparkman, LLP

(57) ABSTRACT

A swivel anchor of a drill string comprises a slip arrangement, comprising a slip body and at least one slip element; upper and lower connections attachable to further components, wherein the slip arrangement is rotatable about a longitudinal axis with respect to the upper and lower connections and a slip joint, comprising upper and lower components, wherein the upper and lower components may move relative to each other parallel with a longitudinal axis, between an open and closed positions, wherein in the open position a longitudinal displacement between the upper and lower components is greater than when the slip joint is in the closed position, and wherein when the slip joint is in the closed position, the swivel anchor length is less than when in the open position.

19 Claims, 5 Drawing Sheets

(56) References Cited

U.S. PATENT DOCUMENTS

| | | | | |
|---|---|---|---|---|
| 3,489,211 | A * | 1/1970 | Kammerer, Jr. | E21B 23/01 166/301 |
| 4,196,781 | A * | 4/1980 | Cheek | E21B 17/07 175/45 |
| 4,427,064 | A | 1/1984 | Bowyer | |
| 4,673,890 | A * | 6/1987 | Copland | E21B 33/124 33/544.2 |
| 5,253,710 | A * | 10/1993 | Carter | E21B 31/16 166/55.6 |
| 2013/0048268 | A1 | 2/2013 | Crow et al. | |
| 2015/0176347 | A1 | 6/2015 | Bansal et al. | |
| 2016/0084019 | A1* | 3/2016 | Montiel | E21B 17/00 166/242.7 |

OTHER PUBLICATIONS

Search Report for United Kingdom Application No. 1813539.2, dated Feb. 13, 2019.

* cited by examiner

SWIVEL ANCHOR

CROSS REFERENCE TO RELATED APPLICATIONS

This is the U.S. National Stage of International Application No. PCT/GB2019/052231, filed Aug. 8, 2019, which was published in English under PCT Article 21(2), which in turn claims the benefit of Great Britain Application No. 1813539.2, filed Aug. 20, 2018. The prior application is incorporated herein in its entirety.

This invention relates a swivel anchor, and in particular concerns a swivel anchor which may be used as part of a drill string to facilitate rotation of one or more other components of the drill string.

A wellbore is typically provided with a casing, which comprises a layer of a robust material such as steel which lines the interior of the wellbore, and provides a barrier between the wellbore and the surrounding formation.

In various circumstances it may be desirable to cut the casing of a wellbore. To do so, a drill string including a pipe cutter will be run into the wellbore to the desired depth. The drill string will then be rotated at a suitable rate, and blades or other cutting implements are deployed outwardly from the pipe cutter. The blades cut through the casing, and once this is complete the blades will typically be retracted once more into the pipe cutter. The drill string may then be retrieved from the wellbore, or alternatively one or more further operations may be carried out as part of the same 'trip'.

When a pipe cutter is used in this way, it is often helpful to include a swivel anchor in the drill string, typically above the pipe cutter. A swivel anchor includes slips or similar elements which dig into and engage with the interior of the casing, thus holding the swivel anchor in place at a desired depth within the wellbore. This ensures that, as the cutting operation proceeds, the pipe cutter also remains at a correct depth within the wellbore.

As the skilled reader will understand, rotational motion applied to components of the drill string above the swivel anchor must be transmitted through the swivel anchor to components of the drill string below the swivel anchor.

Similar features may also be found in rotating liner hangers.

It is an object of the present invention to provide an improved swivel anchor.

Accordingly, one aspect of the present invention provides a swivel anchor for use as part of a drill string, the swivel anchor having a longitudinal axis and a length and comprising: a slip arrangement, comprising a slip body and one or more slip elements, wherein the or each slip element is movable from a retracted position, in which the slip element lies wholly or substantially wholly within the profile of the slip body, and an extended position, in which the slip element protrudes beyond the profile of the slip body and may engage with the casing of a wellbore in which the swivel anchor is positioned; upper and lower connections, by which the swivel anchor may be attached to further components, wherein the slip arrangement is rotatable about the longitudinal axis with respect to the upper and lower connections; and a slip joint, comprising an upper component and a lower component, wherein the upper and lower components may move relative to each other in a direction parallel with the longitudinal axis, between an open position and a closed position of the slip joint, wherein in the open position the longitudinal displacement between the upper component and the lower component is greater than the longitudinal displacement between the upper component and the lower component when the slip joint is in the closed position, and wherein when the slip joint is in the closed position the overall length of the swivel anchor is less than when the slip joint is in the open position.

Advantageously, the or each slip element is constrained to move, with respect to the slip body, along an axis which is inclined with respect to the longitudinal axis.

Preferably, the swivel anchor has an upper connection, by which the swivel anchor may be connected to a further component, and a lower connection, by which the swivel anchor may be connected to a further component, and wherein the length of the swivel anchor is defined between the upper and lower connections.

Conveniently, the upper connection is rotationally linked to the lower connection, and the slip arrangement may rotate with respect to the upper and lower connections.

Advantageously, the upper and lower components of the slip joint are telescopically connected to one another.

Preferably, the swivel anchor further comprises a fixing arrangement, which initially maintains the upper and lower components of the slip joint in a fixed longitudinal position with respect to each other, and wherein the fixing arrangement may be disengaged to allow relative longitudinal motion between the upper and lower components.

Conveniently, the fixing arrangements comprise one or more elements which initially connect the upper and lower components, and wherein the one or more elements may be broken or otherwise deformed to disconnect the upper and lower components from each other.

Advantageously, the slip joint is positioned below the slip arrangement.

Alternatively, the slip joint is positioned above the slip arrangement.

As a further alternative the swivel anchor comprises two slip joints, one positioned above the slip arrangement and the other positioned below the slip arrangement.

Preferably, the slip joint is initially provided in the open position.

Alternatively, the slip joint is initially provided in the closed position.

Preferably, when the slip joint is in the open position, the longitudinal displacement between the upper component and the lower component is greater by at least 7.5 cm (3 inches), than the longitudinal displacement between the upper component and the lower component when the slip joint is in the closed position.

Conveniently, when the slip joint is in the open position, the longitudinal displacement between the upper component and the lower component is greater by no more than 15 cm (6 inches), than the longitudinal displacement between the upper component and the lower component when the slip joint is in the closed position.

Advantageously, the slip joint is the slip joint below the slip arrangement, and wherein, when the slip joint above the slip arrangement is in the open position, the longitudinal displacement between the upper component and the lower component is greater by at least 15 cm (6 inches), than the longitudinal displacement between the upper component and the lower component when the slip joint is in the closed position.

Preferably, for both slip joints, when the slip joint is in the open position, the longitudinal displacement between the upper component and the lower component is greater by no more than 15 cm (6 inches), than the longitudinal displacement between the upper component and the lower component when the slip joint is in the closed position.

Conveniently, the upper and lower components of the slip joint are rotationally linked to each other for at least some of the range of relative motion between the upper and lower components.

Advantageously, the upper and lower components of the slip joint are rotationally linked to each other for the entirety, or substantially the entirety, of the range of relative motion between the upper and lower components.

Preferably, the upper and lower components of the slip joint are rotationally linked to each other for only a first part of the range of relative motion between the upper and lower components, and wherein the upper and lower components are not rotationally linked to each other for a second part of the range of relative motion therebetween.

Conveniently, the swivel anchor further comprises first and second components that may come into contact with each other when the upper and lower components are in the second part of the range of relative motion therebetween, wherein relative rotation of the upper and lower components causes relative rotation between the first and second components, and wherein relative rotation between the first and second components when the first and second components are in contact with each other causes relative longitudinal motion between the upper and lower components of the slip joint.

Advantageously, at least one of the first and second components comprises a surface with at least one protrusion provided thereon.

Preferably, the surface has an undulating profile with a plurality of spaced apart protrusions.

Another aspect of the invention provides a drill string including a swivel anchor according to any of the above.

A further aspect of the present invention provides a method comprising the steps of: providing a drill string including a swivel anchor according to any of the above, which is in an initial open or closed position, and a pipe cutter; running the drill string into a wellbore; moving the or each slip element into the extended position, to grip against the casing; using the pipe cutter to cut, at least partially, the casing of the wellbore; and moving the slip joint from the initial position to a final position, which is closed if the initial position was open and is open if the initial position was closed.

Conveniently, the step of moving the slip joint from the initial position to the final position is carried out in response to the drill string appearing to be jammed in the wellbore following or during use of the pipe cutter.

In order that the invention may be more readily understood, embodiments thereof will now be described, by way of example, with reference to the accompanying figures, in which.

Figure 1:
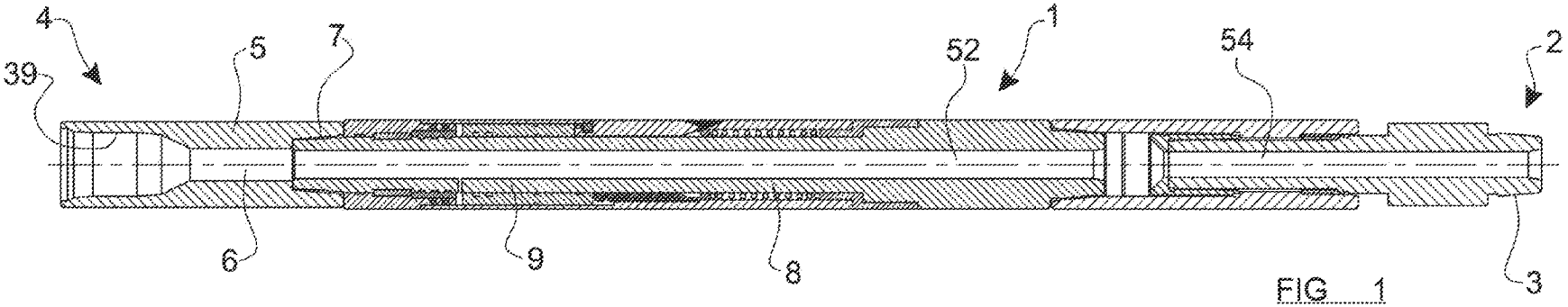
FIGS. 1 and 2 show a swivel anchor embodying the present invention in an initial configuration.
Figure 2:
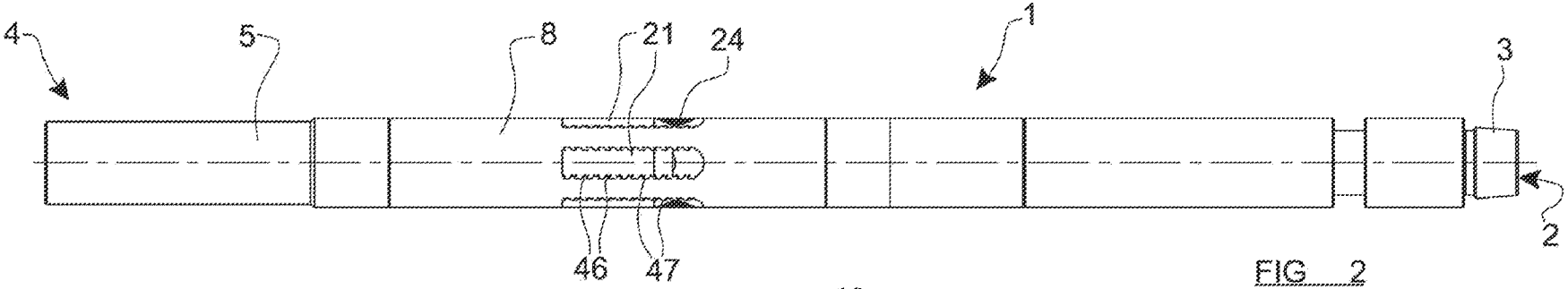

FIG. 1 shows a cut-away side view of a swivel anchor 1 embodying the present invention in an initial state. FIG. 2 is an external side view of the swivel anchor 1 in the initial state. The swivel anchor 1 generally takes an elongate tubular form, dimensioned to fit within a wellbore. At its lower end 2 the swivel anchor 1 includes a threaded connection 3, for connection to a further component of a drill string which is located below the swivel anchor 1. The threaded connection 3 is preferably a male connection, and may be of a standard form.

At its upper end 4 the swivel anchor 1 will have a further threaded connection 39, which is preferably female, for connection to another component of the drill string which is above the swivel anchor 1.

Figure 3:
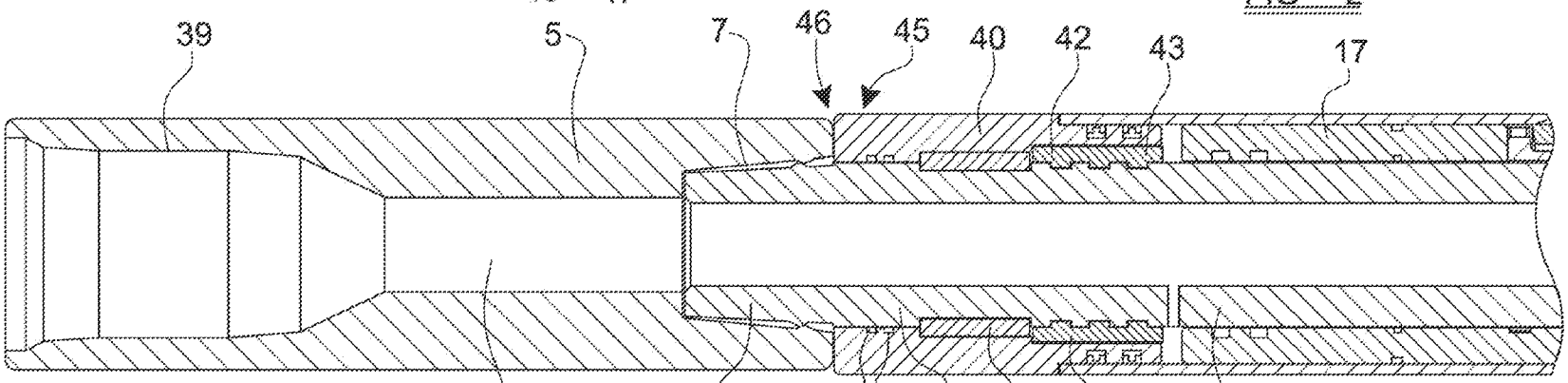
FIGS. 3, 4, 5 and 7 show close-up views of regions of FIG. 1.
Figure 4:
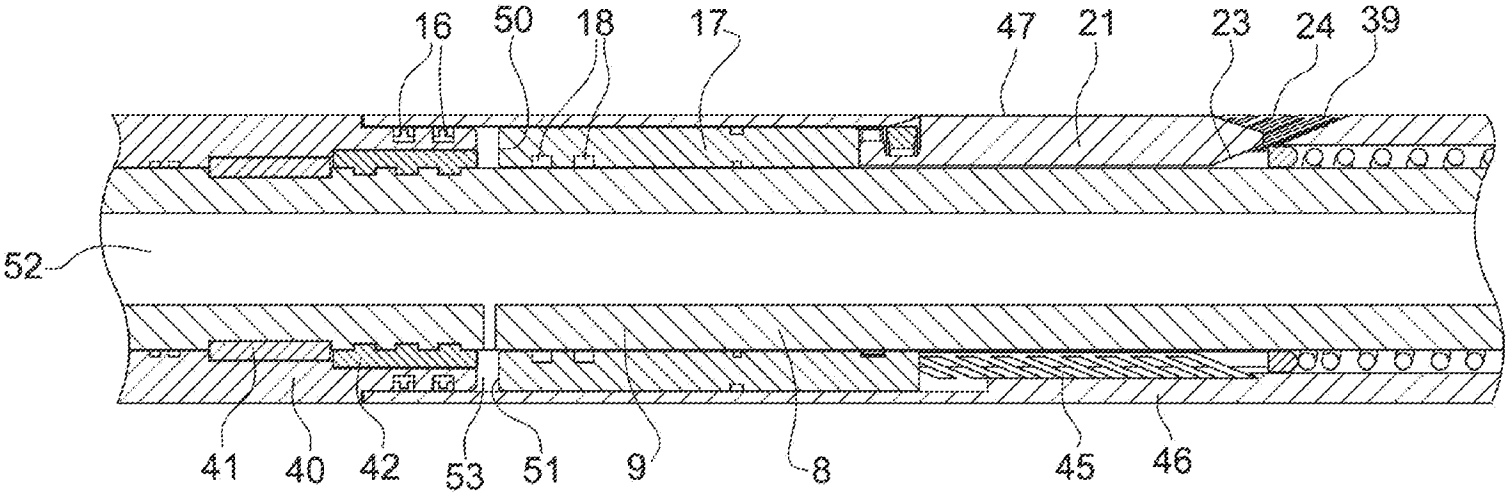

FIG. 3 shows a more close-up view of the top end of the swivel anchor 1, and FIG. 4 shows a more close-up view of a central region of the swivel anchor 1.

The swivel anchor 1 includes an upper body 5, which is provided at its upper end, and has a generally tubular shape. The upper body 5 has a central bore 6 passing therethrough which is preferably centrally disposed within the upper body 5.

At its lower end the upper body 5 has a connection aperture 7 formed therein. The connection aperture preferably has a threaded interior (not shown).

The swivel anchor 1 further comprises a central body 8. An upper part 9 of the central body is generally tubular, and has an outer diameter which is less than the outer diameter of the upper body 5. An upper end 10 of the upper part 9 fits into connection aperture 7 of the upper body 5, and is fixed in position therewith (for instance, through cooperating threaded connections).

A lower part 11 of the central body 8 is wider than the upper part 10 of the central body 8, and preferably has the same or substantially the same outer diameter as that of the upper body 5.

The central body 8 has a bore 52 passing therethrough, which is preferably centrally located, and of the same width as the central bore 6 of the upper body 5.

Through the connection between the upper body 5 and the central body 8, these components are rotationally linked. If the upper body is rotated, this rotation will be transmitted to the central body 8.

As mentioned above, the upper body 5 and the central body 8 may be connected to another through a threaded connection, which for instance may be a standard right-handed threaded connection. In this case, clockwise (as seen from the surface) rotation of the upper body 5 may be transmitted to the central body 8, whereas anti-clockwise rotation of the upper body 5 may serve to disengage (i.e. unscrew) the upper body 5 from the central body 8. References in this document to rotational motion being transmitted between components may refer to rotational motion in only one sense. However, it is common practice in the industry for components of a drill string to be attached to one another through standard right-handed threaded connections, and in this case rotation of the drill string to operate a casing cutter will generally be in the clockwise (as seen from the surface) sense.

The swivel anchor 1 further comprises a torque connection 40, which is positioned around the upper part 9 of the central body 8, below (preferably immediately below) the upper body 5. The torque connection 40 takes the form of a tubular component, having an outer diameter which is the same, or substantially the same, as that of the upper body 5.

A series of splines 41 fit into corresponding opposing grooves formed in the inner surface of the torque connection 40 and the outer surface of the central body 8. As the skilled reader will understand, these splines 41 serve to link the torque connection 40 and the central body 8 rotationally together.

The torque connection 40 also has a load ring 42 provided on its inner surface. The load ring 42 has a series of grooves 43 formed on its inner surface. The outer surface of the central body 8 has a corresponding series of raised annular ribs 44 formed on its outer surface, which fit into the grooves 43 formed on the inner surface of the load ring 42.

The load ring 42 is securely fixed to the inner surface of the torque connection 40. The skilled reader will understand that the presence of the load ring 42 will strongly resist relative longitudinal motion between the torque connection 40 and the central body 8.

In the example shown in the figures, the upper end 45 of the torque connection 40 abuts against the lower end 46 of the upper body 5.

A slip housing 12 is positioned below the torque connection 40, around the narrow upper portion 9 of the central body 8. The slip housing 12 is generally tubular, and has an outer diameter which is preferably the same as that of the upper body 5 and the lower part 11 of the central body 8.

As can be seen in FIG. 1, at its lower end 13 the slip housing 12 meets, or lies adjacent to, the lower part 11 of the central body 8. At its upper end 14, the slip housing 12 overlaps and overlies the lower end of the torque connection 40. Therefore, together the upper body 5, torque connection 40, slip housing 12 and lower part 11 of the central body 8 form a generally continuous, substantially tubular outer cross section of the swivel anchor 1.

Figure 5:
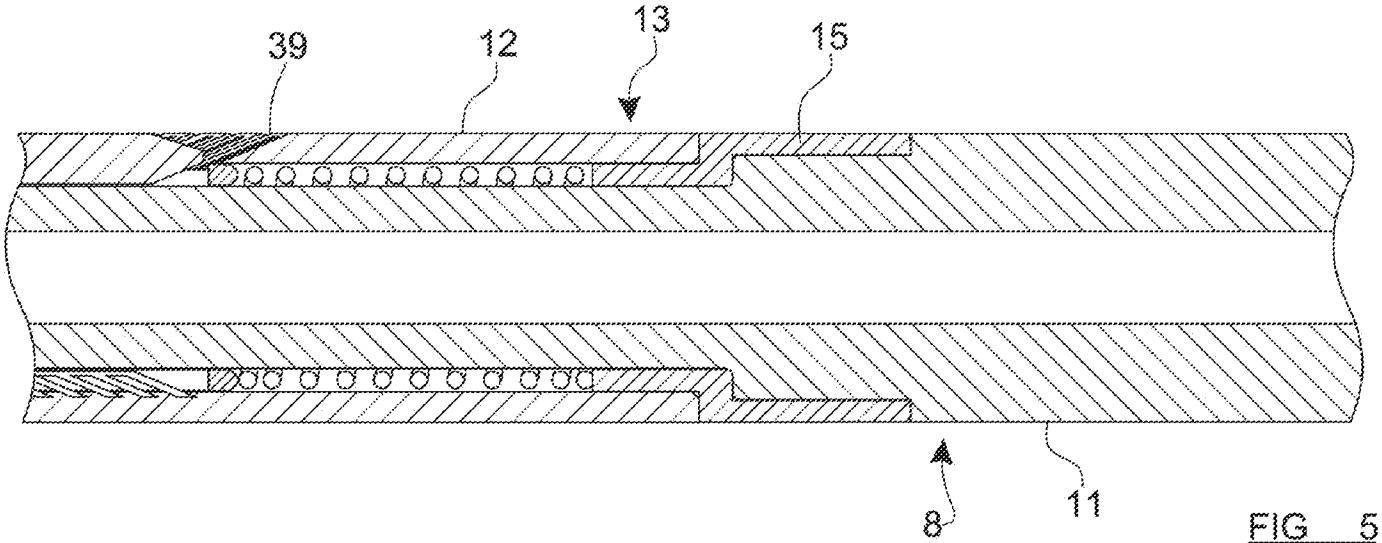

FIG. 5 shows a close-up view of a central region of the swivel anchor 1, below the region shown in FIG. 4.

Positioned between the lower end 13 of the slip housing 12 and the lower part 11 of the central body 8 is a radial and thrust bearing 15, details of which will be understood by the skilled reader. This bearing 15 will allow rotation between the central body 8 and the slip housing 12. Where the upper end 14 of the slip housing meets the upper body 5, a series of rotating seals 16 are placed in respective recesses on the outer surface of the torque connection 40, between the upper surface of the torque connection 40 and the inner surface of the slip housing 12. This also allows rotation of the torque connection 40 with respect to the slip housing 12.

From the above the skilled reader will understand that, if the slip housing 12 is prevented from rotating, rotation of the upper body 5 will be transmitted to the central body 8, and these two components 5, 8 may rotate together while the slip housing 12 remains rotationally stationary.

A slip piston 17 is positioned within the slip housing 12, in the space between the slip housing 12 and the exterior of the upper part 10 of the central body 8. The slip piston 17 is constrained to rotate with the slip housing 12. In the example shown, a further series of rotating seals 18 are provided between the inner surface of the slip piston 17 and the outer surface of the central body 8, to ensure that the central body 8 can rotate effectively within the slip piston 17.

Figure 6:
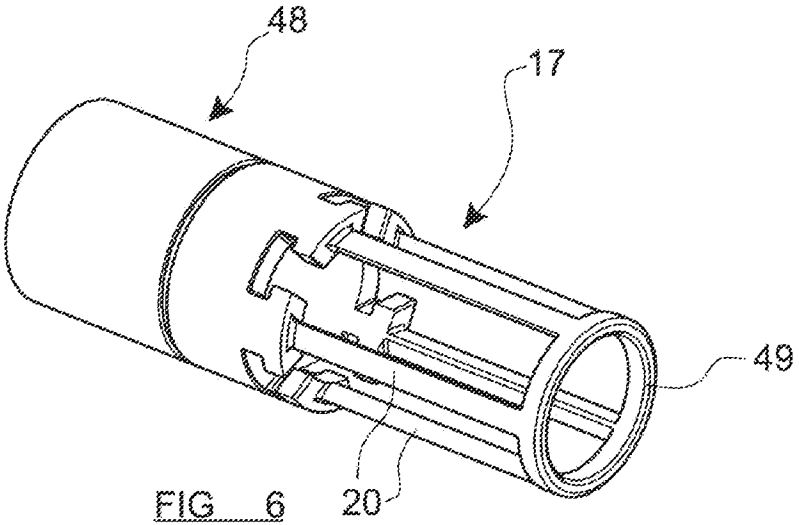
FIG. 6 shows a slip piston of the swivel anchor of FIGS. 1 and 2.

The slip piston 17 is shown in isolation in FIG. 6. As can be seen in this figure, at its upper end 48 the slip piston 17 is generally hollow and tubular. At its lower end 19 the slip piston 17 has a series of radially spaced apart protruding fingers 20. A ring 49 is connected to the lower end of each finger 20. In the example shown, there are six fingers 20, but any other suitable number may be used.

As can be seen most clearly in FIG. 4, the slip piston 17 has an annular surface 50 at its top end, which faces upwardly (i.e. is generally perpendicular to the longitudinal axis of the swivel anchor). A communication port 51 is provided through the wall of the central body 8 above the slip piston 17, allowing communication between the central bore 52 of the central body and an outer chamber 53, which is defined between the outer surface of the central body 8 and the inner surface of the slip housing 12. The lower side of this chamber 53 is defined by the annular surface 50 of the slip piston 17, and the upper side of the chamber 53 is (in the embodiment shown) defined by the lower end of the torque connection 40.

Returning to FIG. 4, in the space between each pair of fingers 20, a slip element 21 is provided. At its lower end 22, each slip element has an inclined inward-facing surface 23, which slopes outwardly and downwardly. The angle of the inclined surface 23, with respect to the longitudinal axis of the swivel anchor, may be between around 7° and around 30°, and in the depicted embodiment is 20°. Any suitable angle may be used.

A series of radially spaced-apart windows 24 are provided through the slip housing 12, and each slip element 21 is aligned with one of these windows 24. Each window 24 has, at its lower end, an inclined deflection surface 39, the angle of which matches or substantially matches that of the inclined surface 23 at the lower end 22 of each slip element 21.

On each of its side edges, each slip element 21 has a series of outwardly-protruding inclined ribs 45, which can be seen most clearly in FIG. 4. These ribs 45 fit into corresponding inclined grooves 46, which are formed in the side edges 47 of each window 24, as can be seen in FIG. 2. The result of the interaction between the ribs 45 and the grooves 46 is that each slip element 21 is constrained to move only along an axis which is parallel with the grooves 46. This allows each slip element 21 to move outwardly, beyond the outer diameter of the slip housing 12, and also downwardly towards the lower end 2 of the swivel anchor 1. As the skilled reader will understand, this will allow each slip element 21 to be moved outwardly into a deployed position, as explained in more detail below, with an outer gripping surface 47 of each slip element 21 remaining parallel with the longitudinal axis of the swivel anchor 1 (and hence with a wellbore in which the swivel anchor 1 is positioned) throughout this movement.

The angle of the ribs 45 and the grooves 46 with respect to the longitudinal axis of the swivel anchor is preferably the same as the angle of inclination of the inclined surface 23 at the lower end 22 of each slip element 21.

In the initial position shown in FIGS. 1 to 5, the slip piston 17 lies close to the lower end of the torque connection 40. A biasing spring 25 is positioned between the lower end of the slip piston 17 and an upper surface 26 of the thrust bearing 15 (or against another component which is fixed longitudinally in place with respect to the central body 8). Preferably the spring 25 abuts against the ring 49 at the lower end of the slip piston 17. The spring 25 biases the slip piston 17 upwardly (i.e. towards the upper body 5).

At its lower end 27, the central body 8 is connected (for instance, by a threaded connection 28) to a slip joint 29. This can be seen most clearly in FIG. 7, which is a close-up view of the lower part of the swivel anchor 1.

The slip joint 29 includes an upper component 30, which is connected to the lower end of the central body 8, and a lower component 31, which is telescopically received within the interior of the upper component 30. The telescopic arrangement of the upper and lower components 30, 31 allows relative movement between these two components, as will be described in more detail below. At the lower end 32 of the lower component 31, the lower threaded connection 3 of the swivel anchor 1 is formed.

The upper component 30 is generally hollow and tubular. The lower component 31 has a stem 33 on its upper side which fits into, and may slide within, the hollow interior of the upper component 30. The lower component 31 also has a widened portion 34, below the stem, which is too wide to fit into the hollow interior of the upper portion 30 and has an outer diameter which is the same or substantially the same as that of the upper body 5.

In the initial configuration shown in FIGS. 1 to 7, the slip joint 29 is in an extended configuration, with a gap 35 being present between the lower end 36 of the upper portion 30 and the widened portion 34 of the lower part 31.

In preferred embodiments one or more shear pins (not shown), or similar components, are provided to hold the upper and lower components 30, 31 of the slip joint 29 in the initial, extended configuration. If sufficient longitudinal force is applied to the slip joint 29, the shear pins may be broken, allowing relative motion between the upper and lower parts 30, 31.

The invention is not limited to shear pins, and any other suitable kind of frangible arrangement may be provided, such as shear rings, latches, collets, dogs, springs, and so on.

Figure 7:
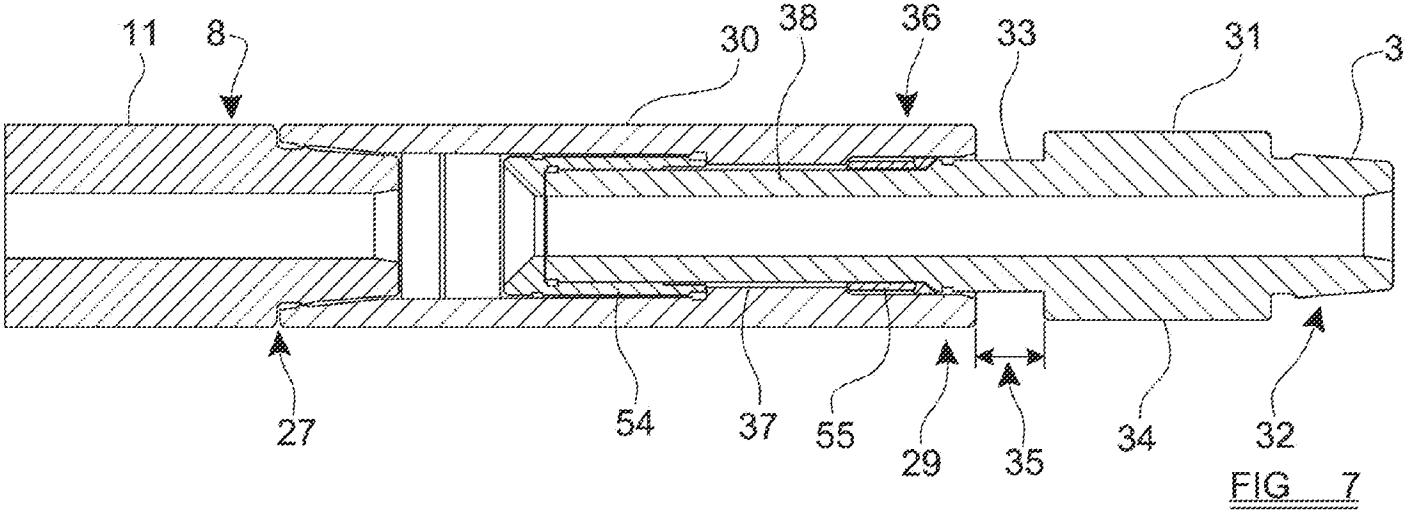

As can be seen in FIG. 7, the upper component 30 has a widened inner portion 37. The stem 33 of the lower portion 31 has a narrowed section 38 into which the protrusion 37 fits. However, above and below the narrowed section 38 the stem 33 is wider, and is too wide to fit through the narrowed section 37. The skilled reader will understand that this limits the 'stroke' of the lower component 31 with respect to the upper component 30, and also prevents the upper and lower components 30, 31 from becoming entirely detached from one another.

A series of splines or similar features are provided so that rotation is transmitted from the upper component 30 to the lower component 31 throughout the allowed range of motion between these components. In the example shown, splines 55 are provided on an inner surface of the upper component 30, below the narrowed section 37, and these splines 55 are received in corresponding grooves of the lower component 31.

The slip joint 29 preferably has a central bore 54 passing therethrough, which is of the same, or substantially the same, diameter as the bore 52 passing through the central body 8.

Use of the swivel anchor 1 in a cutting operation will now be described.

The swivel anchor 1 is incorporated into a drill string, which (as the skilled reader will understand) may include many other components. Below the swivel anchor, as described above, a pipe cutter forms part of the drill string (the pipe cutter may be attached directly to the lower threaded connection 3 of the swivel anchor 1, or one or more intervening components may be present).

The drill string is run into a wellbore until the pipe cutter is at a desired depth.

Figure 8:
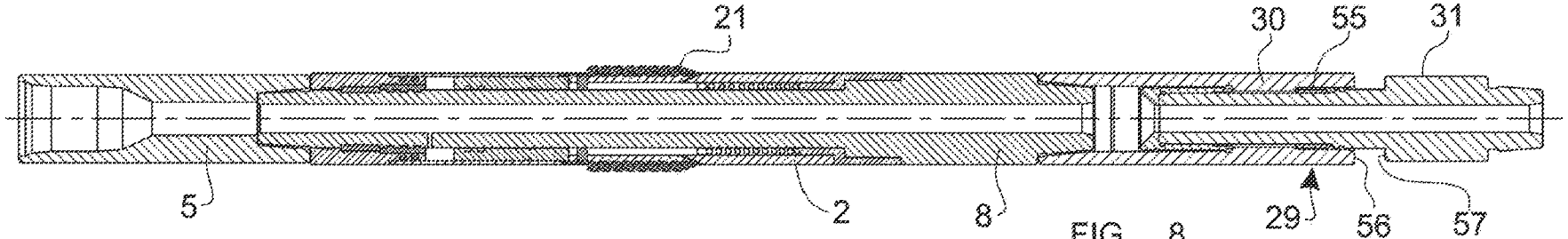
FIGS. 8 and 9 show the swivel anchor of FIGS. 1 and 2, with slip elements thereof deployed.
Figure 9:
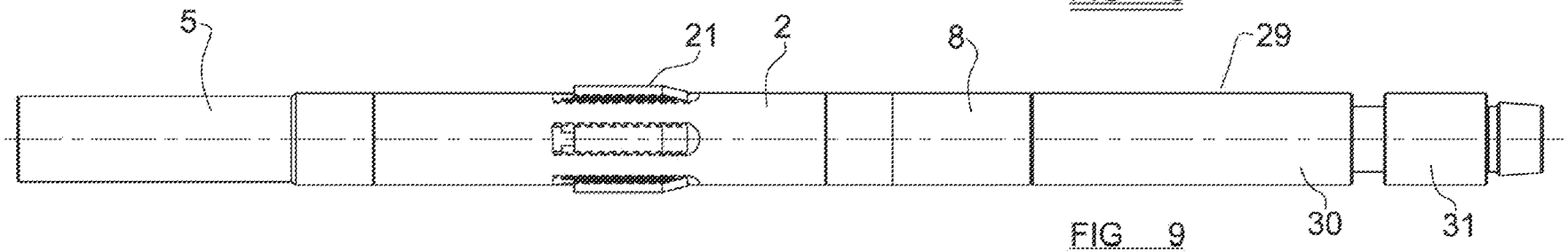

The rate of fluid circulation through the swivel anchor 1 will then be increased. Fluid will flow through the communication port 51 and into the chamber 53, and the pressure of the fluid will act against the annular upper surface 50 of the slip piston 17. This will have the effect of driving the slip piston 17 downwardly with respect to the slip housing 12. This will in turn drive the slips 21 downwardly, and the lower inclined surfaces 23 thereof will interact with the inclined deflection surfaces 39 of the casing windows 24, thus pushing the slip elements 21 outwardly, so that they extend radially outwardly beyond the outer diameter of the slip housing 12. This position is shown in FIGS. 8 and 9. When in this position, the slip elements 21 will engage with and bite into the interior of the casing (not shown), thus fixing the swivel anchor 1 in place longitudinally with respect to the casing. As will be understood by those skilled in the art, the outer surfaces of the slip elements 21 may have ribs, teeth or other protrusions and/or indentations on their outer surfaces to increase the effectiveness of the grip between the slip elements 21 and the interior of the casing.

With the slip elements 21 in the deployed position, as shown in FIGS. 8 and 9, the drill string may be rotated from the surface. This will cause the upper body 5 to rotate, and this rotational motion will be transmitted downwardly through the torque connection 40, central body 8 and slip joint 29 to the pipe cutter below. To initiate the cutting operation, one or more blades or other cutters of the pipe cutter may be deployed outwardly, for instance through dropping of a ball or other object through the drill string, or through setting a suitable rate of circulation of fluid through the drill string.

If all goes well, once the cutting operation is complete, the blades or cutters can be retracted, and rotation of the drill string brought to a halt. The rate of circulation of fluid through the drill string can then be reduced so that the biasing force provided by the spring 25 pushes the slip piston 17 (and hence the slip elements 21) upwardly, so the slip elements 21 return to the retracted position shown in FIG. 1. The drill string may then be retrieved from the wellbore, or moved to another position within the wellbore for another procedure to be carried out.

However, in some operations it has been found that the blades or cutters of the pipe cutter become jammed in the casing. Typically, the blades or cutters swivel outwardly and upwardly from the pipe cutter, and if these blades or cutters become jammed in the casing then they can only be released by raising the pipe cutter upwardly with respect to the wellbore. Driving the pipe cutter downwardly with respect to the wellbore would be likely to jam the blades or cutters even more firmly into the material of the casing, or simply to drive the blades or cutters downwardly through the material of the casing, to a position where they are still jammed.

However, if the pipe cutter is provided in a drill string with a swivel anchor similar to the one shown in FIG. 1, but not including a slip joint 29, it will be understood that the drill string cannot be pulled upwardly, because this motion will be prevented by the engagement between the slip elements 21 and the casing. The slip elements 21 can only be disengaged from the casing by pushing the drill string downwardly with respect to the casing.

The drill string as a whole may therefore be jammed. The drill string may not be pulled upwardly, because of the slip elements 21, but may not be pushed downwardly because of the jammed blades or cutters. In situations like this the drill string may need to be retrieved by other means, which is likely to involve significant time and expense. Alternatively, the well may have to be abandoned in its entirety.

Figure 10:
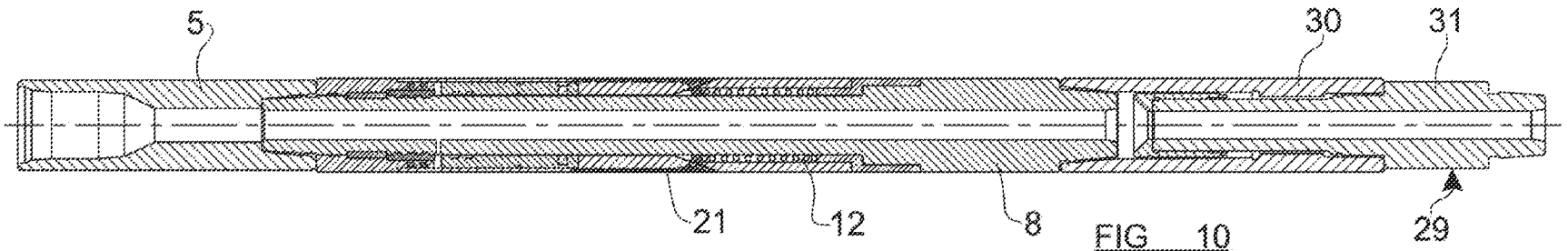
FIGS. 10 and 11 show the swivel anchor of FIGS. 1 and 2, with a slip joint thereof in the closed position.
Figure 11:
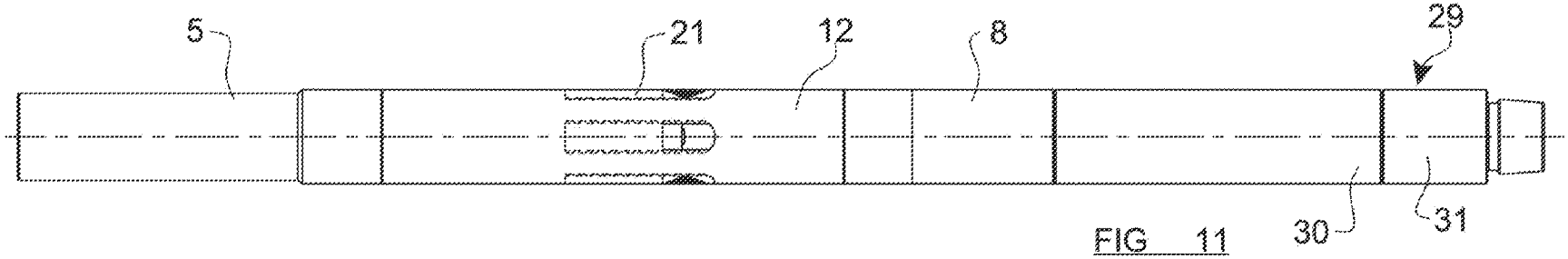

However, the presence of the slip joint 29 allows a jam of this type to be resolved. If operators of the surface find that the drill string is jammed in this way, the drill string may be pushed downwardly with sufficient force to break the shear pins in the slip joint 29. The components of the drill string above the slip joint 29 may then be pushed downwardly, to close the gap 35 between the upper and lower components 30, 31 of the slip joint 29, thus reducing the overall length of the swivel anchor 1. This will allow the slip elements 21 to be retracted to a position within the outer diameter of the swivel anchor 1. The resulting configuration is shown in FIGS. 10 and 11.

The drill string may then be pulled upwardly, to release the cutters or blades of the casing cutter. The drill string as a whole will then be free to move upwardly or downwardly with respect to the wellbore. The cutting operation could then be recommenced, or the drill string may be retrieved and pulled up to the surface so the slip joint 29 can be reset or replaced before a further attempt is made to cut the casing.

The skilled reader will understand that the swivel anchors described herein are robust and relatively simple, and also allow a relatively common type of jamming that occurs during cutting operations to be resolved quickly and easily.

The distance by which the upper and lower components 30, 31 of the slip joint 29 move with respect to each other, in moving from the open configuration to the closed configuration, is preferably at least 7.5 cm (3 inches). The distance is also preferably less than 15 cm (6 inches). In embodiments the length of this motion only needs to be enough to allow the slips 21 to retract into the body of the swivel anchor 1. Some prior art "bumper subs" have very long strokes—up to 120 cm (4 feet)—to create the largest possible shock when activated. The stroke of the slip joint 29 in the swivel anchor 1 does not, in many embodiments, need to be this long.

In the description above, the slip joint 29 is provided below the slip elements 21. This is the preferred configuration, since collapsing of the slip joint (i.e. to the configuration shown in FIGS. 10 and 11) will then allow a downward stroke of the swivel anchor 1 in the region of the slip elements 21, thus allowing the slip elements 21 to be disengaged. In such configurations the slip joint 29 will usually (although not in all instances) initially be provided in the open position.

It is also envisaged that the slip joint may be provided above the slip elements 21, however. While this will not directly allow a downward stroke in the same way, breaking the shear pins and collapsing the slip joint 29 will allow operators at the surface to apply a sharp jolt or 'bump' to the swivel anchor, which may have the effect of breaking the connection between the slip elements and the interior of the casing. Once again, in such configurations the slip joint will usually be initially set in the open position.

The skilled reader will also appreciate that all of the components described above are for a relatively large central bore which passes through the entirety of the swivel anchor 1, including the slip joint 29. Prior to cutting the casing of a wellbore, it may be desired to displace a quantity of a substance such as cement through the drill string and into the wellbore to plug or seal off the wellbore. Providing a swivel anchor with a relatively large central bore will facilitate the displacement of cement or another substance through the swivel anchor 1. In preferred embodiments, the swivel anchor 1 has a central bore passing all the way along its length, having a diameter of at least 5 cm (2 inches) and more preferably at least 6.25 cm (2.5 inches). This central bore preferably passes all the way along the swivel anchor, without any significant restrictions or features protruding into the bore.

It is envisaged that the torque connection 40 described above may be omitted from certain embodiments, and that the central body 8 may be connected to the upper body 5 in a way that links these components together robustly, both longitudinally and rotationally.

In the discussion above, the slip joint 29 comprises upper and lower components 30, 31 which are separate from the other components of the swivel anchor 1. However, one or both components of the slip joint 29 may comprise another component of the swivel anchor 1. For instance, the central body 8 may be modified so that the lower component 31 fits telescopically directly into the lower end of the central body 8 to form the slip joint.

As mentioned above, it is preferred that the upper and lower components 30, 31 of the slip joint 29 are rotationally linked to each other, for instance by the use of splines 55, throughout the allowed range of motion between these components. However, in other embodiments, for some of the allowed range of motion between the upper and lower components 30, 31 of the slip joint 29, these components 30, 31 are not rotationally linked together.

For example, where the slip joint 29 is initially provided in the open configuration (as shown in the attached drawings), the slip joint 29 may be configured so that the upper and lower components 30, 31 are rotationally linked together when the slip joint 29 is in the open position, but the upper and lower components 30, 31 are not rotationally linked when the slip joint 29 is in the closed position. This may be achieved, for example, by providing splines and corresponding grooves which are engaged with each other when the slip joint 29 is in the open position, but where the splines have a length such that they move out of engagement with the grooves at a point during the movement of the slip joint 29 from the open position to the closed position, so that when the slip joint 29 is in the fully closed position the upper and lower components 30, 31 may rotate with respect to each other. The skilled reader will be able to think of other ways in which the components 30, 31 can become rotationally disengaged from each other.

In such embodiments, surfaces of the upper and lower components 30, 31 that come into contact with each other when the slip joint 29 is in the closed position may have an irregular, wavy or undulating profile, so that relative rotation between the upper and lower components 30, 31 causes relative longitudinal motion between these components.

Referring to FIG. 8, a downward-facing surface 56 of the upper component 30, and an upward-facing surface 57 of the lower component 31, are shown. When the slip joint 29 is in the closed position, these two surfaces 56, 57 will come into contact with each other. In the example shown in FIG. 8, these surfaces are both flat and planar. However, in other embodiments these components may have protrusions thereon, such as slopes and/or undulations. Rotation of the drill string above the swivel anchor 1 will cause the upper component 30 to rotate, but this rotation will not be transmitted directly to the lower component 31. The lower component 31 may be connected to a pipe cutter further down the wellbore, which is jammed and hence strongly resists rotation. Rotation of the drill string above the swivel anchor 1 will therefore cause relative rotation of the upper and lower components 30, 31. As this occurs the protruding features of the two surfaces 56 will cause longitudinal motion of the upper and lower components 30, 31.

This feature may be useful if activation of the slip joint 29, to drive (for example) the slip joint 29 from the open position to the closed position, fails to resolve a jam in the wellbore. Repeated longitudinal motion arising from interaction of the surfaces 56, 57 of the upper and lower components 30, 31 of the slip joint 29 may serve to bump or shake components free and disengage them from the casing (or other components), thus freeing the drill string from a jam.

During this rotation, compression may be applied to the drill string from the surface, so that the surfaces 56, 57 are repeatedly re-engaged with each other during the rotational motion.

In other embodiments, instead of both surfaces 56, 57 being wavy or undulating, only one of the surfaces may be wavy or undulating, with the other surface having a feature which will follow, or be deflected longitudinally by, the wavy or undulating surface.

In the example described above rotation is transmitted through the slip joint 29 when it is in the open position, and the upper and lower components 30, 31 are rotationally disengaged in the closed position. However, this may be reversed, and relative rotation in the open position may lead to relative longitudinal motion between the upper and lower components 30, 31. Tension may be applied to the drill string from the surface during this rotation. The skilled reader will understand how this may be achieved.

It is also envisaged that the slip joint 29 may transmit rotation in the fully closed position, and also transmit rotation in the fully open position, but when the slip joint 29 is in an intermediate position the upper and lower components 30, 31 are rotationally disengaged. This may be achieved, for example, by providing an upper spline and a lower spline on the lower component 31, with a space between the two, and grooves on the upper component 30 that are sufficiently short to engage neither the upper spline nor the lower spline in an intermediate position.

This document makes reference to a swivel anchor, which is provided as a single tool including both a slip arrangement and a slip joint. It should be understood that this refers to a single component to be included in a drill string, preferably having upper and lower standard connections (such as threaded connections) to allow the tool to be attached to adjacent components in the drill string.

The term "swivel anchor", as used in this document, refers to a single tool and is not intended to encompass an arrangement where a conventional swivel anchor is connected to a separately-provided component which, such as a bumper sub, which allows a change in length.

Preferably, the swivel anchor has a standard drill string connection (i.e. a connection of the type by which the components that make up a known drill string are wholly, or primarily, connected to each other) at its upper end, and a further standard drill string connection at its lower end, but does not include any other standard drill string connections along its length.

Preferably the swivel anchor is manufactured and supplied as a single unit, and further preferably this unit cannot be disassembled to separate the slip arrangement from the slip joint without specialist tools, and/or without interfering with the functioning of one or both of the slip arrangement and the slip joint.

Figure 12:
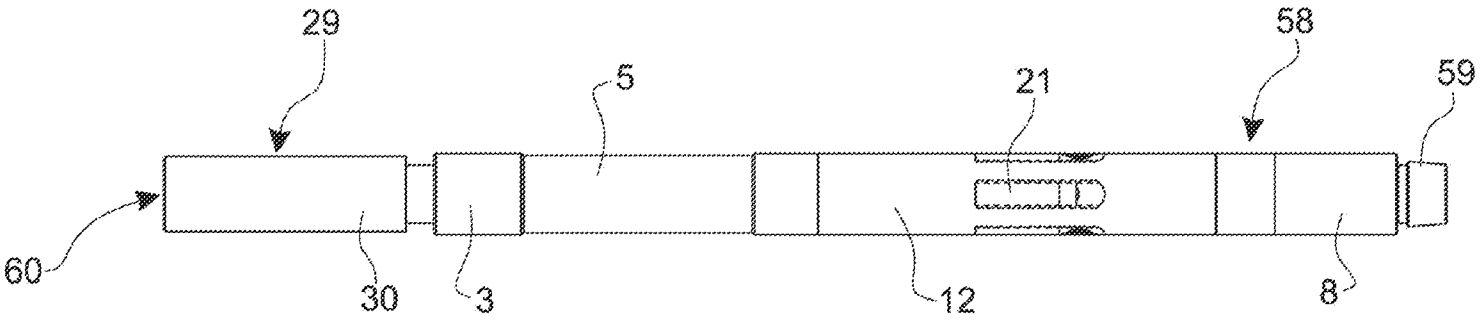
FIG. 12 shows a further swivel anchor with a slip joint at its upper end.

In the discussion above, a swivel anchor is provided which has a slip joint at its lower end. However, as mentioned above the slip joint could also be provided at the upper end of the swivel joint. With reference to FIG. 12, a further swivel anchor 58 is shown, having effectively the same features as the swivel anchor 1 shown in FIGS. 1 to 11, but with the slip joint 29 positioned at the top of the swivel anchor 58, so that the lower component 31 of the slip joint 29 is connected to the upper body 5. A standard threaded connection 59 is preferably provided at the lower end of the swivel anchor 58 (i.e. at the bottom end of the central body 8), and a standard threaded connection 60 is also preferably provided at the top end of the upper component 30 of the slip joint 29.

The skilled reader will understand how to make the necessary modifications for the slip joint to be positioned at the upper end of the swivel anchor 58, as shown in FIG. 12.

Figure 13:
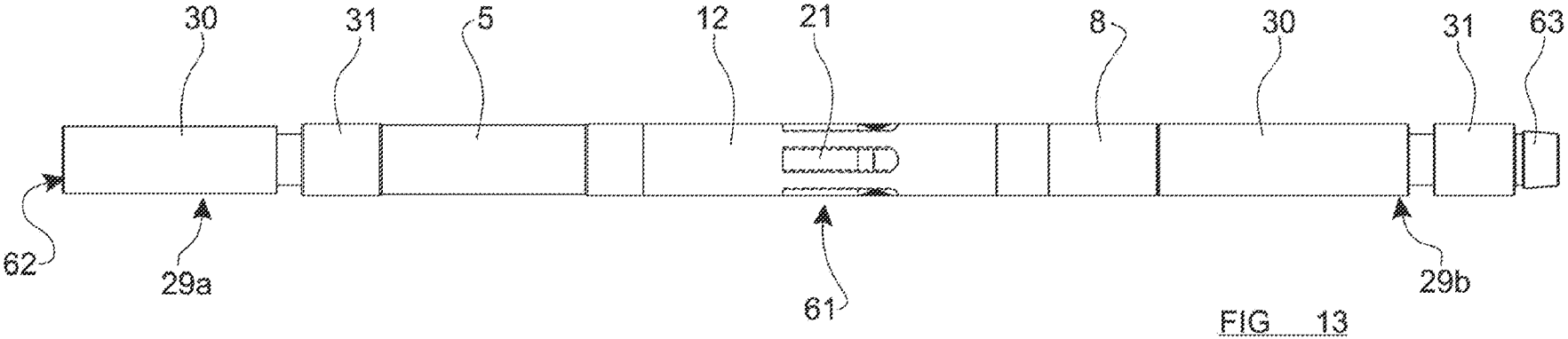
FIG. 13 shows a third swivel anchor with respective slip joints at its upper and lower ends.

FIG. 13 shows a third swivel anchor 61, which includes a first slip joint 29*a* at its upper end, and a second slip joint 29*b* at its lower end. The third swivel anchor 60 preferably has a standard threaded connection 62 at the upper end of the upper part 30 of the first slip joint 29*a*, and preferably has a further standard threaded connection 63 at the lower end of the lower component 31 of the second slip joint 29*b*. It will be clear to the skilled reader from the discussion above how this may be achieved.

Providing two slip joints 29*a*, 29*b* in this way may be useful in several ways. In one example, both slip joints 29*a*, 29*b* are initially provided in the open position (this is in any event likely to be the most straightforward way to configure the drill string, since the weight of the drill string will tend to pull the slip joints 29*a*, 29*b* into the open position. If a jam is detected, as discussed above, the first (i.e. upper) slip joint 29*a* may be driven into the closed position, from the surface, and this will have the effect of creating a shock or "bump" which should release or loosen the connection between the slips 21 and the interior of the casing. The second (i.e. lower) slip joint 29*b* can then be driven into the closed position, to cause the slips 21 to retract into the body of the swivel anchor 61. It should then be possible to raise the drill string, to disengage the blades of the pipe cutter.

It will be understood that providing first and second slip joints 29*a*, 29*b* in this way will provide operators at the surface with an increased range of options for taking action to release a jam in the wellbore.

As discussed above in relation to FIGS. 1 to 11, the stroke of the slip joint is preferably at least 7.5 cm (3 inches) and is preferably no more than 15 cm (6 inches). This is also preferably the case for the second slip joint 29*b* of the third swivel anchor 61. However, the stroke of the first slip joint 29*a* may be longer than this, as the main purpose of the first slip joint 29*a* may be to generate the largest possible shock to try and dislodge components below.

In some embodiments the stroke of the first slip joint 29*a* may also be restricted to a relatively short length, such as between around 7.5 cm (3 inches) and 15 cm (6 inches), to ensure that the swivel anchor 61 is not excessively long.

In the description above the terms "upper", "lower", "above" and "below" are used. It is envisaged that swivel anchors embodying the invention will be run into a wellbore, as part of a drill string, through a wellbore entrance at the surface. The parts referred to as "upper" or "above" are expected to be closer to the wellbore entrance than parts referred to as "lower" or "below". This is irrespective of the angle of the wellbore at any particular location. However, in certain circumstances it may be desired to run a swivel anchor embodying the invention into a wellbore in the opposite orientation. No limitations on the invention should be inferred from the use of terms such as "upper", "lower", "above" and "below", and these merely serve as a frame of reference to assist in describing the swivel anchor.

It also envisaged that the any of the swivel anchors 1, 58, 61 disclosed herein could be run into a wellbore in the opposite orientation to that shown and discussed above, i.e. upside down. This is likely to be useful to set a fixed depth when using a floating installation, so that ocean "heave" does not damage or destroy the tool if surface compensators are not able to cope with the forces arising from the heave. In these embodiments it is expected that the slip joint (or both slip joints, if two are provided) will initially be set in the closed position. To activate the (or each) slip joint, the drill string may be pulled upwardly to move the slip joint into the open position, either to deliver a shock or bump to the components (most likely for a slip joint closer to the surface than the slip arrangement), or to allow the slips to retract (most likely for a slip joint further from the surface than the slip arrangement).

One advantage of embodiments of the invention is that the swivel anchor may be formed to have a consistent outer diameter along its length. As can be seen from the figures, aside from a narrower section which is present when a slip joint is in the open configuration, and the threaded connections at the end of the swivel anchor, the outer diameter of the swivel anchor is constant or substantially constant along its length. The skilled reader will understand the advantages that this provides, particularly with regard to flow and rotation during cementing and/or cutting processes.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A swivel anchor for use as part of a drill string, the swivel anchor having a longitudinal axis and a length and comprising:

a slip arrangement, comprising a slip body and at least one slip element, wherein the at least one slip element is movable from a retracted position, in which the slip element lies wholly or substantially wholly within the profile of the slip body, and an extended position, in which the slip element protrudes beyond the profile of the slip body and may engage with the casing of a wellbore in which the swivel anchor is positioned;

upper and lower connections at respective upper and lower ends of the swivel anchor, by which the swivel anchor may be attached to further components, wherein an overall length of the swivel anchor is defined by a distance between the upper and lower connections, wherein the slip arrangement is rotatable about the longitudinal axis with respect to the upper and lower connections; and a slip joint, comprising an upper component and a lower component, wherein the upper and lower components may move relative to each other in a direction parallel with the longitudinal axis, between an open position and a closed position of the slip joint, wherein in the open position the longitudinal displacement between the upper component and the lower component is greater than the longitudinal displacement between the upper component and the lower component when the slip joint is in the closed position, and wherein when the slip joint is in the closed position the overall length of the swivel anchor between the upper and lower connections is less than when the slip joint is in the open position.

2. A swivel anchor according to claim 1, wherein the at least one slip element is constrained to move, with respect to the slip body, along an axis which is inclined with respect to the longitudinal axis.

3. A swivel anchor according to claim 1, wherein the upper connection is rotationally linked to the lower connection.

4. A swivel anchor according claim 1, wherein the upper and lower components of the slip joint are telescopically connected to one another.

5. A swivel anchor according to claim 1, further comprising a fixing arrangement, which initially maintains the upper and lower components of the slip joint in a fixed longitudinal position with respect to each other, and wherein the fixing arrangement may be disengaged to allow relative longitudinal motion between the upper and lower components.

6. A swivel anchor according to claim 5, wherein the fixing arrangement comprises one or more elements which initially connect the upper and lower components, and wherein the one or more elements may be broken or otherwise deformed to disconnect the upper and lower components from each other.

7. A swivel anchor according to claim 1, wherein the slip joint is positioned below the slip arrangement.

8. A swivel anchor according to claim 1, wherein the slip joint is positioned above the slip arrangement.

9. A swivel anchor according to claim 1, wherein the slip joint is initially provided in the open position.

10. A swivel anchor according to claim 1 wherein, when the slip joint is in the open position, the longitudinal displacement between the upper component and the lower component is greater by at least 7.5 cm (3 inches) than the longitudinal displacement between the upper component and the lower component when the slip joint is in the closed position.

11. A swivel anchor according to claim 1 wherein, when the slip joint is in the open position, the longitudinal displacement between the upper component and the lower component is greater by no more than 15 cm (6 inches) than the longitudinal displacement between the upper component and the lower component when the slip joint is in the closed position.

12. A swivel anchor according to claim 1, wherein the upper and lower components of the slip joint are rotationally linked to each other for at least some of the range of relative motion between the upper and lower components.

13. A swivel anchor according to claim 12, wherein the upper and lower components of the slip joint are rotationally linked to each other for the entirety, or substantially the entirety, of the range of relative motion between the upper and lower components.

14. A swivel anchor according to claim 13, wherein the upper and lower components of the slip joint are rotationally linked to each other for only a first part of the range of relative motion between the upper and lower components, and wherein the upper and lower components are not rotationally linked to each other for a second part of the range of relative motion therebetween.

15. A swivel anchor according to claim 14, further comprising first and second components that may come into contact with each other when the upper and lower components are in the second part of the range of relative motion therebetween, wherein relative rotation of the upper and lower components causes relative rotation between the first and second components, and wherein relative rotation between the first and second components when the first and second components are in contact with each other causes relative longitudinal motion between the upper and lower components of the slip joint.

16. A swivel anchor according to claim 15, wherein at least one of the first and second components comprises a surface with at least one protrusion provided thereon.

17. A drill string including a swivel anchor according to claim 1.

18. A method comprising:

providing a drill string including a swivel anchor according to claim 1, which is in an initial open or closed position, and a pipe cutter;

running the drill string into a wellbore;

moving the or each slip element into the extended position, to grip against the casing;

using the pipe cutter to cut, at least partially, the casing of the wellbore; and moving the slip joint from the initial position to a final position, which is closed if the initial position was open and is open if the initial position was closed.

19. A method according to claim 18, wherein the step of moving the slip joint from the initial position to the final position is carried out in response to the drill string appearing to be jammed in the wellbore following or during use of the pipe cutter.

* * * * *